United States Patent [19]

Babiol

[11] 4,391,383

[45] Jul. 5, 1983

[54] OVERSEALING CAPS

[75] Inventor: Pierre Babiol, Villefranche sur Saone, France

[73] Assignee: Societe Nouvelle de Bouchons Plastiques S.N.B.P., Anse, France

[21] Appl. No.: 280,001

[22] PCT Filed: Nov. 13, 1979

[86] PCT No.: PCT/FR79/00105

§ 371 Date: Jul. 7, 1981

§ 102(e) Date: Jul. 7, 1981

[87] PCT Pub. No.: WO81/01399

PCT Pub. Date: May 28, 1981

[51] Int. Cl.[3] ..... B65D 41/48

[52] U.S. Cl. ..... 215/256

[58] Field of Search ..... 215/256; 220/270, 276

[56] References Cited

U.S. PATENT DOCUMENTS

| | | | |
|---|---|---|---|
| 3,109,547 | 11/1963 | Wood | 215/256 |
| 4,066,181 | 3/1976 | Robinson et al. | 215/256 |
| 4,076,140 | 2/1978 | Perne | 215/256 |

FOREIGN PATENT DOCUMENTS

| | | | |
|---|---|---|---|
| 2108783 | 5/1972 | France | 215/256 |
| 2280560 | 2/1976 | France | 215/256 |

*Primary Examiner*—Donald F. Norton

*Attorney, Agent, or Firm*—Dowell & Dowell

[57] ABSTRACT

A capping capsule with a thin wall comprising a tearable guarantee strip connected to the skirt of said capsule by means of two rupture lines of reduced thickness. The tearable guarantee strip is provided with vertical ribs spaced from each other, the thickness of which rapidly decreases to reach zero at the edges of said strip defining the crimping lines.

4 Claims, 4 Drawing Figures

OVERSEALING CAPS

The present invention relates to improvements in capping capsules and more particularly, although not exclusively, of the type described in the applicant's French Pat. No. 76 06230, granted Aug. 13, 1979 on an application filed Feb. 27, 1976.

Devices of the above mentioned type are particularly appreciated when provided with a tearable strip enabling their opening without the use of an instrument such as a knife. The setting of such a tearable strip creates necessarily a fragile zone due to the fact that said strip is connected to the skirt of the capsule by rupture lines of reduced thickness which have a low resistance to damage. Rupture of the capsule often occurs around these lines when it is positioned by setting over the neck of a bottle and more particularly if this setting is carried out by exerting considerable effort on the bottom of the capsule.

The improvements of the present invention aim to remedy these drawbacks in order to obtain a tearable strip:

does not collapse during the positioning of the capsule and avoids the rupture of the tear lines which define it;

prevents a faulty tear-off of the guarantee strip, that is to say which avoids a tear that would not follow the crimping lines;

increases the grip on the tearable strip when the user takes hold of it.

According to the invention, the strip of the capping capsule is provided with spaced vertical ribs, the thickness of which decreases rapidly to reach zero at both edges that define the rupture lines of said strip.

The attached drawing given by way of example will enable a better understanding of the invention, of its characteristics and advantages:

FIG. 1 shows a capping capsule 1 which is intended to be placed on the neck of a bottle in order to cover it, to constitute a guarantee element for its contents, and/or to decorate it. The capsule which is illustrated is similar to the one which is the subject of the aforesaid French patent, but the invention may of course be applied to any capsule provided with a tearable strip.

Figure 1:
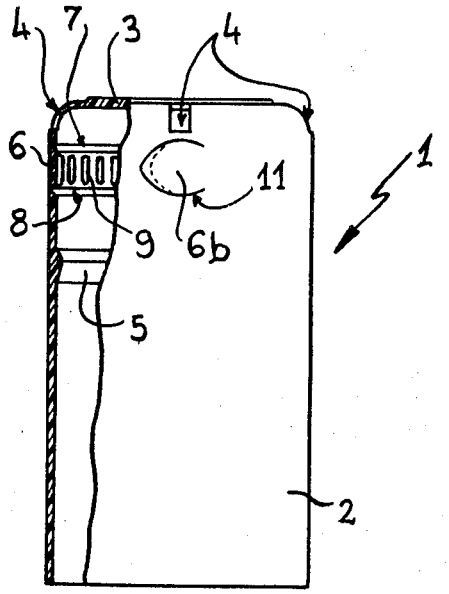
FIG. 1 is a partly sectioned elevation view of a capping capsule whose tearable strip comprises the improvements according to the invention.

The capsule illustrated in FIG. 1 comprises a tubular body or skirt 2 which is closed at one of its ends by a bottom part 3 whose junction to the skirt is provided with holes 4 intended to permit air to escape during the positioning of the capsule. A rib 5 is provided inside the skirt 2 to enable the capsule 1 to be fixed on the bottle neck by a snap action of the rib under the ring of the neck.

Figure 2:
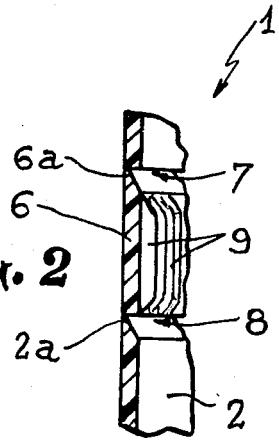
FIG. 2 is a partial section of the capsule on a large scale.

A tearable guarantee strip 6 is provided in the skirt between the rib 5 and the bottom part 3. As more particularly illustrated in FIG. 2, the strip 6 being connected to the skirt by means of two peripheral grooves situated in the thickness of the skirt on the inside thereof. These grooves define crimping lines 7, 8 and have a triangular shaped cross-section so that the guarantee strip is actually connected to the skirt by only two thin edges, one of them **6*a* being integral with the strip 6 and the other one 2*a* being integral with the skirt 2**.

When such a capsule has to be positioned on the neck of a bottle by axial action on its bottom part 3, it is easily understandable that the pressure causes the collapse of the strip 6 and usually the breaking of the crimping lines 7, 8 at the edges **2*a*, 6*a***.

Figure 3:
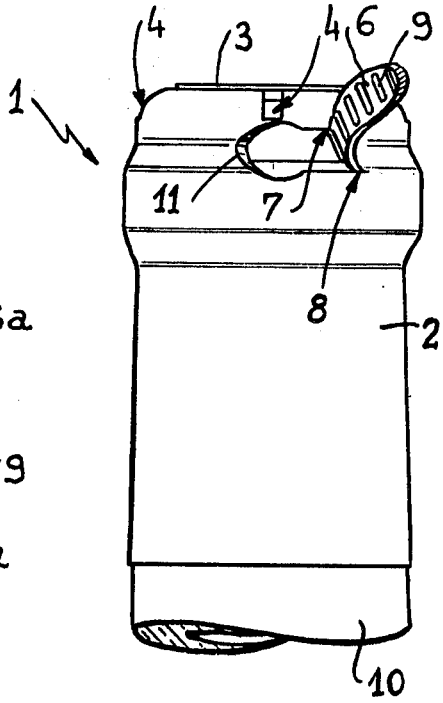
FIG. 3 is a view similar to the one of FIG. 1 but showing the beginning of the tearing-off of the guarantee strip.

According to the invention, the innerside of the tearable strip is provided with vertical ribs 9 spaced from each other and whose thickness aims at increasing the moment of inertia of the cross-section of the strip 6 in order to avoid the distortion of said strip by positioning of the capsule when an axial strain is applied on the bottom part 3. The thickness of the ribs 9 depends upon the thickness of the strip and upon the effort to be applied on the bottom part 3 of the capsule to position its skirt correctly surrounding the neck 10 of a bottle (FIG. 3). The thickness of each rib decreases rapidly to reach zero at the edges **2*a*, 6*a***.

In order to provide in a zone of the strip 6 an end **6*b* which will be easily accessible by the user and in order to enable the tearing-off of said strip, there is provided, after moulding of the capsule, a cut-out or stamped portion 11 made by means of a tool shaped as a gouge cutting right through the strip (FIG. 1**). This gouge is preferably disposed obliquely with respect to the periphery of said strip, that is to say orientated in a non-normal way with regard to this periphery.

In order to tear off the strip 6, the user introduces his nail or any instrument under the portion 11 so as to raise the end **6*b* of the strip which then constitutes a gripping element. Since its inner face is provided with ribs 9**, the grip of the fingers to this gripping element is improved and therefore the tearing-off of the strip is made easier.

Figure 4:
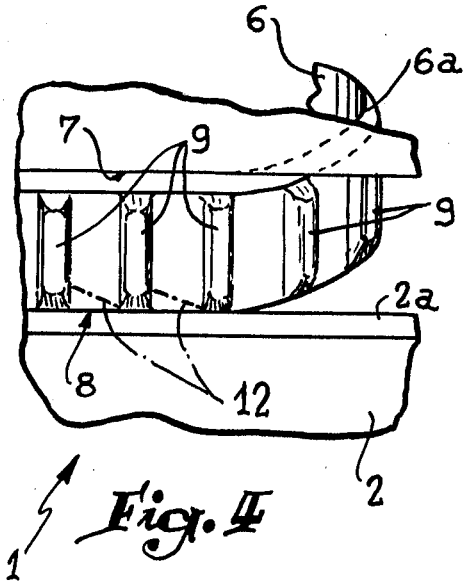
FIG. 4 illustrates on a large scale the way in which the ribs according to the invention prevent a faulty tear-off of the guarantee strip.

In the case of a usual tearable guarantee strip, a faulty tear-off movement often occurs at the rupture lines. In other words, it sometimes happens that tearing action moves away from a rupture line and across the strip itself which is thus cut off. It therefore becomes impossible to tear off completely the guarantee strip. On the contrary, according to the present invention, if a tear-off starts within the height of the guarantee strip, for instance following the line 12, illustrated by dotted lines in FIG. 4, such a tear will end against the base of the following rib 9 so that, upon further tearing-off effort, the tearing of the strip occurs along the base of the rib in a direction of the crimping line 7,8. In that way, the tearing-off is corrected each time an undesirable tear starts diverging from the provided tear-off zone.

It must of course be understood that the above description has only been given by way of example and that it in no way limits the field of the invention which would not be departed from by replacing some details described herein by any other equivalents.

What is claimed is:

1. A capping capsule with a thin wall comprising a closed end and an axially extending skirt including a circumferential tear-off guarantee strip which is joined at its upper and lower edges to the skirt at two rupture lines defined by two circumferential grooves extending around the inside of the skirt and separated by the height of the guarantee strip, and the guarantee strip including on its inner face multiple circumferentially spaced axially extending ribs, the thickness of each rib decreasing abruptly near its ends and blending into the rupture lines.

2. A capsule in accordance with claim 1, wherein the strip is made integral with the skirt and continuous along its length.

3. A capsule in accordance with claim 2, wherein the strip has an end portion which is cut from the skirt by an arcuate slit passing through the skirt at an angle which is oblique with respect to the radial direction.

4. A capsule in accordance with claim 3, wherein the strip has rib means located on said end portion to form means to increase manual grip on the strip.

* * * * *